US010081489B2

(12) United States Patent
Morand

(10) Patent No.: US 10,081,489 B2
(45) Date of Patent: Sep. 25, 2018

(54) WASTE-DISPOSAL SYSTEM FOR FILM-DISPENSING UNITS

(75) Inventor: Michel Morand, Montréal (CA)

(73) Assignee: INTERNATIONAL REFILLS COMPANY LIMITED, Christ Church (BB)

( * ) Notice: Subject to any disclaimer, the term of this patent is extended or adjusted under 35 U.S.C. 154(b) by 0 days.

(21) Appl. No.: 13/400,929

(22) Filed: Feb. 21, 2012

(65) Prior Publication Data

US 2012/0211494 A1 Aug. 23, 2012

Related U.S. Application Data

(60) Provisional application No. 61/444,237, filed on Feb. 18, 2011.

(51) Int. Cl.
*B65D 25/16* (2006.01)
*B65F 1/06* (2006.01)
*B65D 6/40* (2006.01)

(52) U.S. Cl.
CPC ..... *B65F 1/062* (2013.01); *B65F 2240/132* (2013.01); *Y10T 29/49817* (2015.01); *Y10T 29/49826* (2015.01)

(58) Field of Classification Search
CPC ..... B65F 1/062; B65F 2240/132; Y10T 29/49817; Y10T 29/49826
USPC .... 220/495.05, 908.3, 908.1, 495.07, 495.08
See application file for complete search history.

(56) References Cited

U.S. PATENT DOCUMENTS 4,934,529 A * 6/1990 Richards ..... B65B 9/15 206/303
6,128,890 A * 10/2000 Firth ..... 53/567
6,719,194 B2 * 4/2004 Richards ..... 232/43.1
6,974,029 B2 * 12/2005 Morand et al. ..... 206/303
7,100,767 B2 * 9/2006 Chomik ..... A47K 11/02 206/409
7,350,663 B2 * 4/2008 Chomik et al. ..... 220/264
(Continued)

FOREIGN PATENT DOCUMENTS

FR 2743357 A1 7/1997
GB 2261359 A 5/1993

OTHER PUBLICATIONS

International Search Report ; International Application No. PCT/CA2012/050093; International Application Filing Date Feb. 17, 2012; dated May 1, 2012.

(Continued)

*Primary Examiner* — J. Gregory Pickett
*Assistant Examiner* — Niki M Eloshway
(74) *Attorney, Agent, or Firm* — Cantor Colburn LLP

(57) ABSTRACT

A waste-disposal unit comprises a bin having an open top end for accessing an inner cavity of the bin. A support in the bin is adapted to support a bag unit at the open top end for waste to be received in the bag unit in the inner cavity of the bin. A covering device is removably positioned on the bin at the open top end. The covering device comprises a body for covering at least a portion of the bag unit when installed on the top open end. A downward projection on the covering device, the downward projection adapted to have at least a tip thereof positioned lower than an uppermost edge of the bag unit, and inward of an outermost edge of the bag unit in the inner cavity of the bin. A method for inserting a bag unit in the bin is also provided.

13 Claims, 5 Drawing Sheets

(56) References Cited

U.S. PATENT DOCUMENTS

| | | | | |
|---|---|---|---|---|
| 7,712,285 | B2 * | 5/2010 | Stravitz et al. | 53/77 |
| 7,931,150 | B2 * | 4/2011 | Morand | 206/554 |
| 7,958,704 | B2 * | 6/2011 | Stravitz et al. | 53/567 |
| 8,087,532 | B2 * | 1/2012 | Brown et al. | 220/264 |
| 8,235,237 | B1 * | 8/2012 | Stravitz | 220/264 |
| 8,393,489 | B1 * | 3/2013 | Stravitz | 220/264 |
| 2003/0121923 | A1 * | 7/2003 | Morand et al. | 220/495.07 |
| 2005/0115207 | A1 * | 6/2005 | Chomik | B65B 7/12 53/459 |
| 2008/0121640 | A1 * | 5/2008 | Chomik et al. | 220/495.07 |
| 2011/0056953 | A1 * | 3/2011 | Ohnishi et al. | 220/495.07 |

OTHER PUBLICATIONS

Written Opinion; International Application No. PCT/CA2012/050093; International Application Filing Date Feb. 17, 2012; dated May 1, 2012.

* cited by examiner

WASTE-DISPOSAL SYSTEM FOR FILM-DISPENSING UNITS

CROSS-REFERENCE TO RELATED APPLICATION

The present application claims priority to U.S. Provisional Patent Application No. 61/444,237, filed on Feb. 18, 2011, which is incorporated herein by reference in its entirety.

FIELD OF THE APPLICATION

The present application relates to waste-disposal systems of the type having a bin or pail supporting film-dispensing units, with the tube-dispensing units dispensing a closed-end tube or bag in the bin to receive and conceal odorous waste.

BACKGROUND OF THE ART

Waste-disposal systems having tube-dispensing units or refills are commonly used, for numerous reasons. One of the reasons is that such systems often have mechanisms to retain odors. Also, such waste-disposal systems are made to limit the manipulations of bags, to avoid hand contamination. However, any configuration ensuring that the tube-dispensing units are correctly installed in the bins, and that the tube-dispensing unit remains in place in the waste-disposal bin, are desirable. By having the tube-dispensing units correctly installed in the bins, one ensures that the bag is properly sealed and that the risk of hand contamination is minimized.

SUMMARY OF THE APPLICATION

It is therefore an aim of the present disclosure to provide a novel waste-disposal system and bin.

It is a further aim of the present disclosure to provide a waste-disposal system and waste-disposal bin addressing issues associated with the prior art.

Therefore, in accordance with a first embodiment of the present application, there is provided a waste-disposal unit comprising: a bin having an open top end for accessing an inner cavity of the bin, a support in the bin being adapted to support a bag unit at the open top end for waste to be received in the bag unit in the inner cavity of the bin; and a covering device removably positioned on the bin at the open top end, the covering device comprising a body for covering at least a portion of the bag unit when installed on the top open end, at least one downward projection on the covering device, the at least one downward projection adapted to have at least a tip thereof positioned lower than an uppermost edge of the bag unit, and inward of an outermost edge of the bag unit in the inner cavity of the bin.

Further in accordance with the first embodiment, the covering device is a funnel comprising an annular wall defining a central opening for dumping waste therethrough into the bin.

Still further in accordance with the first embodiment, the funnel is pivotally connected to the bin.

Still further in accordance with the first embodiment, one downward projection is a peripheral wall.

Still further in accordance with the first embodiment, the peripheral wall has a 360° annular periphery.

Still further in accordance with the first embodiment, the bag unit is a tube-dispensing unit having an annular body with tubular film in an accumulated condition within the annular body, the tubular film having a free end projecting out of the annular body through a central opening thereof, the free end being closed within the inner cavity of the bin.

Still further in accordance with the first embodiment, the annular body comprises an outer annular wall.

Still further in accordance with the first embodiment, the downward projection is received in an annular cavity of the annular body inward of the outer annular wall.

Still further in accordance with the first embodiment, the outer annular wall is sandwiched between the downward projection and the support of the bin.

Still further in accordance with the first embodiment, a flange is defined on the outer annular wall, the flange cooperating with the support of the bin when the bag unit is supported by the bin.

Still further in accordance with the first embodiment, the tube-dispensing unit comprises a cover, with an annular opening being defined between an edge of the cover and an edge of the outer annular wall, with the free end of the tube exiting the annular body through the annular opening and with the downward projection entering the tube-dispensing unit through the annular opening and outward of the free end of the tube.

Still further in accordance with the first embodiment, the covering device is a lid closing the open top end of the bin.

Still further in accordance with the first embodiment, snap-fitting means are between the covering device and the bin for releasably locking the covering device to the bin.

In accordance with a second embodiment of the present disclosure, there is provided a method for inserting a bag unit in a bin comprising: positioning the bag unit in an open top end of the bin such that the bottom end of the bag is in an inner cavity of the bin; and inserting a downward projection lower than an uppermost edge of the bag unit and inward of an outermost edge of the bag unit by installing a covering device on the open top end of the bin.

Further in accordance with the second embodiment, a previously used bag unit is removed from the bin prior to positioning the bag unit therein.

Still further in accordance with the second embodiment, the covering device is pivoted into engagement with the bin.

DESCRIPTION OF THE PREFERRED EMBODIMENTS

Figure 1:
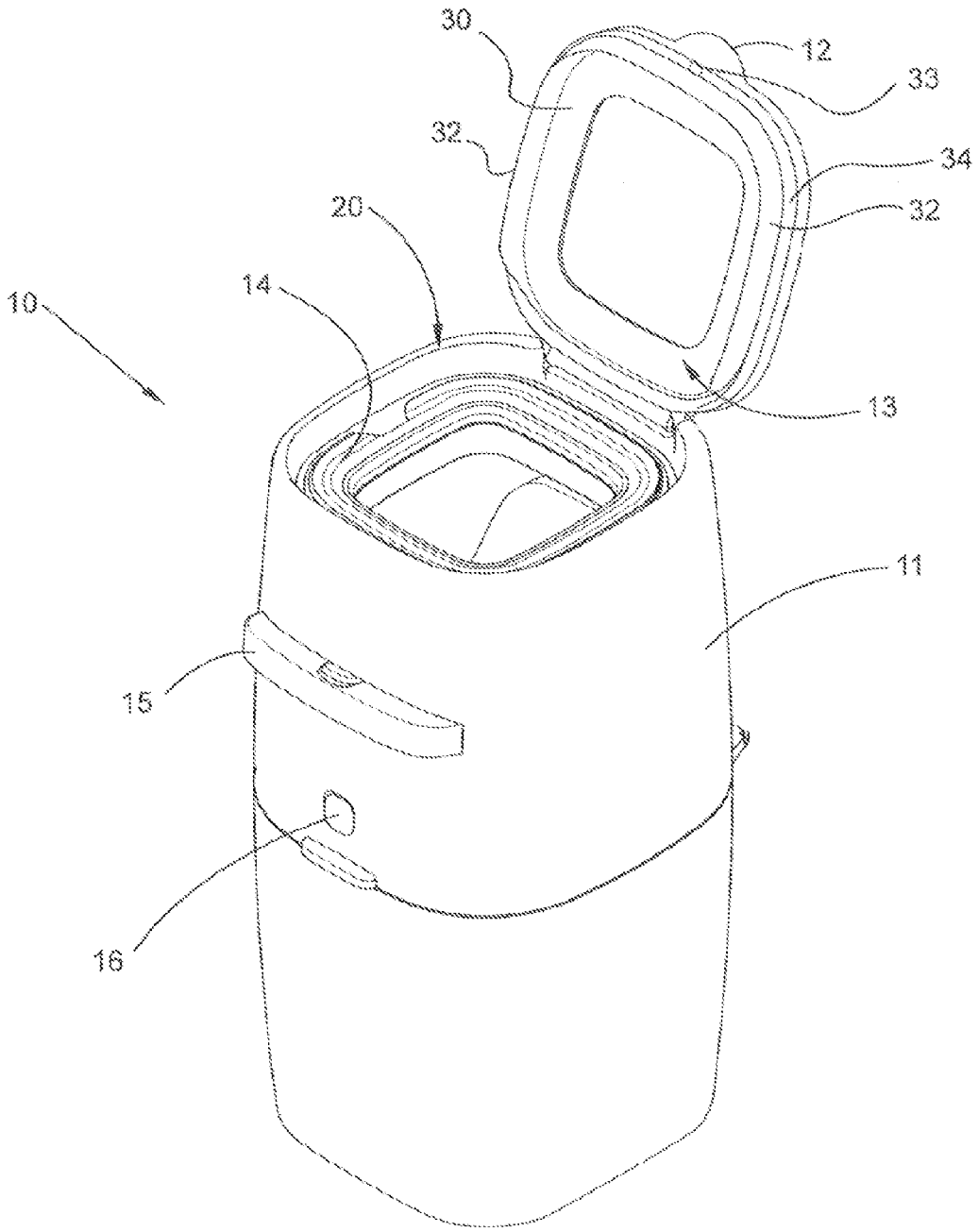
FIG. 1 is a perspective view of a waste-disposal system in accordance with an embodiment of the present disclosure.

Referring to the drawings, and more particularly to FIG. 1, there is illustrated a waste-disposal system 10 in accordance with an embodiment of the present disclosure. The waste-disposal system 10 is of the type having a bin 11 for accommodating waste.

The bin 11 defines an inner cavity for accommodating waste. Any appropriate waste may be dumped into the bin 11, but the waste-disposal system 10 may be used efficiently with diapers, pet litter, and other such odorous waste.

The interior of the bin 11 is accessible via an open top end thereof. The open top end of the bin 11 may be covered and/or closed by different covering devices, namely lid 12 and funnel 13. The open top end may have any appropriate shape, such as that of a square, a rectangle, an ellipse, a circle, etc. In an embodiment, the lid 12 is pivotally connected to a rim of the bin 11.

Referring to FIGS. 1-5, there is also shown the funnel 13. The funnel 13 is provided to protect a tube dispensing unit 14 that is supported by the bin 11. Additional covering devices should also be used in addition to the lid 12 and the funnel 13.

The tube-dispensing unit 14 (also referred to as bag unit) dispenses tubular film and is therefore manipulated by the user, and is typically sold separately from the waste-disposal unit (i.e., bin 11, lid 12, funnel 13, and closing mechanism) of the waste-disposal system 10. Due to its manipulation, it is therefore preferred to protect the tube-dispensing unit 14 from waste, by way of the funnel 13. Moreover, as described hereinafter, the funnel 13 may ensure that the tube-dispensing unit 14 maintains its shape when dispensing film. The tube-dispensing unit or bag unit 14 may include any adapter by which it will be installed in the bin 11. The tube-dispensing unit 14 has a shape that may be similar to that of the open top end of the bin 11.

Jaw 15 is of the type having a handle portion projecting out of the bin 11, which handle is used to manually displace the jaw 15. The jaw 15 shuts the bag of the tube-dispensing unit 14 shut to capture odorous gases within the waste-disposal system 10. Any other type of jaw or bag closing mechanism may be used, such as pedal mechanisms, etc. For instance, the mechanisms shown in U.S. Pat. Nos. 7,406,814, 7,617,660 and 7,931,150, PCT application publication No. WO 2011/011895, incorporated herein by reference, may be used. In the illustrated embodiment, the jaw 15 is part of a mechanism that extends out of the bin 11, but other configurations are known and may be used as alternatives. It is also considered to not have any bag closing mechanism in the bin 11.

Detent 16 may be provided on the outer surface of the bin 11. The detent 16 is pressed to separate the bottom from the upper part of the bin 11, so as to access an interior of the bin 11, for instance, to cut away full bags.

Figure 2:
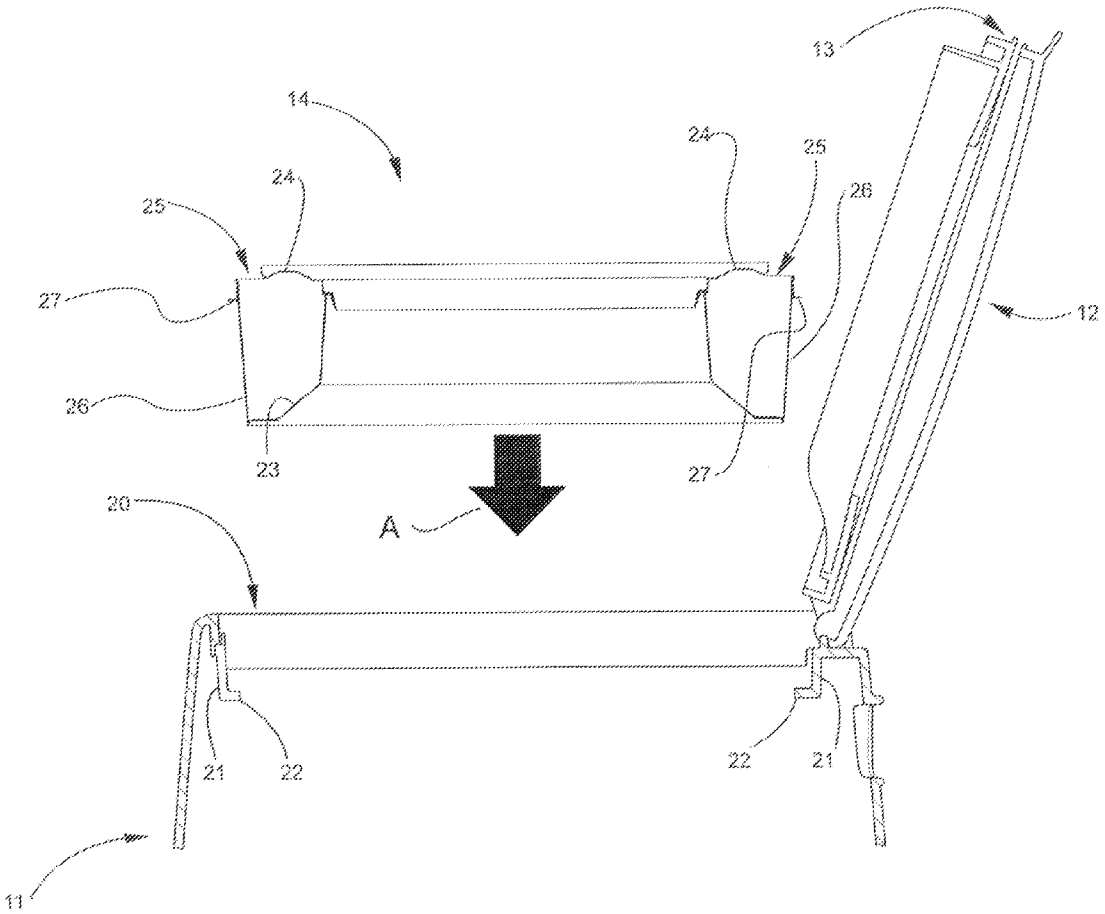
FIG. 2 is a sectional assembly view illustrating a bin and a tube-dispensing unit of the waste-disposal system of FIG. 1, prior to the installation of the tube-dispensing unit into the bin.

Referring to FIG. 2, the tube-dispensing unit 14 is positioned above an open top end 20 of the bin 11, for subsequent installation along direction A. The bin 11 has an inward wall 21, projecting into its inner cavity. A flange 22 extends toward a center of the bin 11, and is generally horizontal. The flange 22 supports the tube-dispensing unit 14, such that tubular film from the unit 14 may extend into the inner cavity of the bin 11. Any other appropriate support that is equivalent to the flange 22 are considered, such as a shoulder, an abutment, etc., provided that some abutment surface(s) are provided to support the unit 14.

Figure 3:
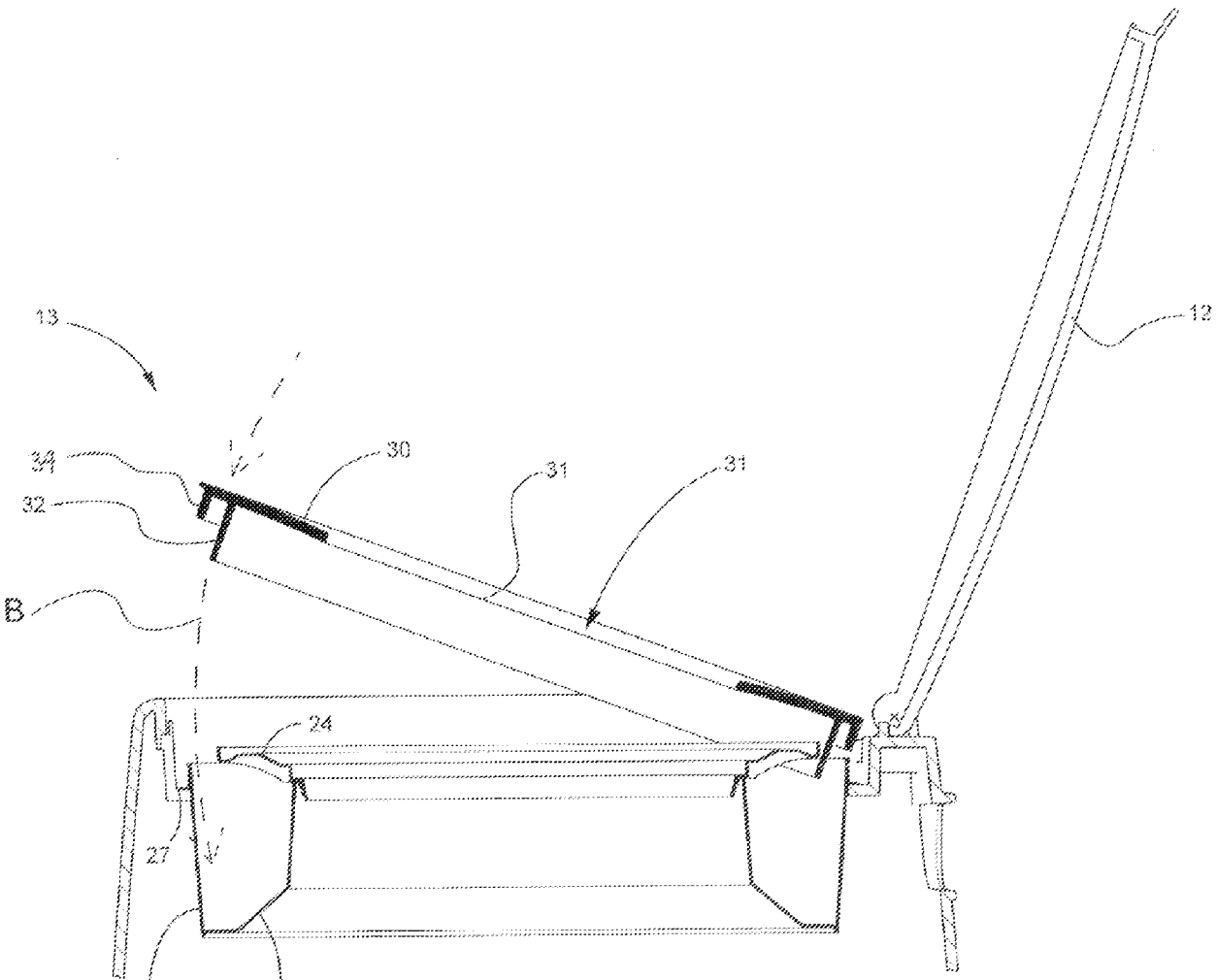
FIG. 3 is a sectional view of the waste-disposal system subsequent to FIG. 2, with a funnel being pivoted toward engagement with the tube-dispensing unit.
Figure 5:
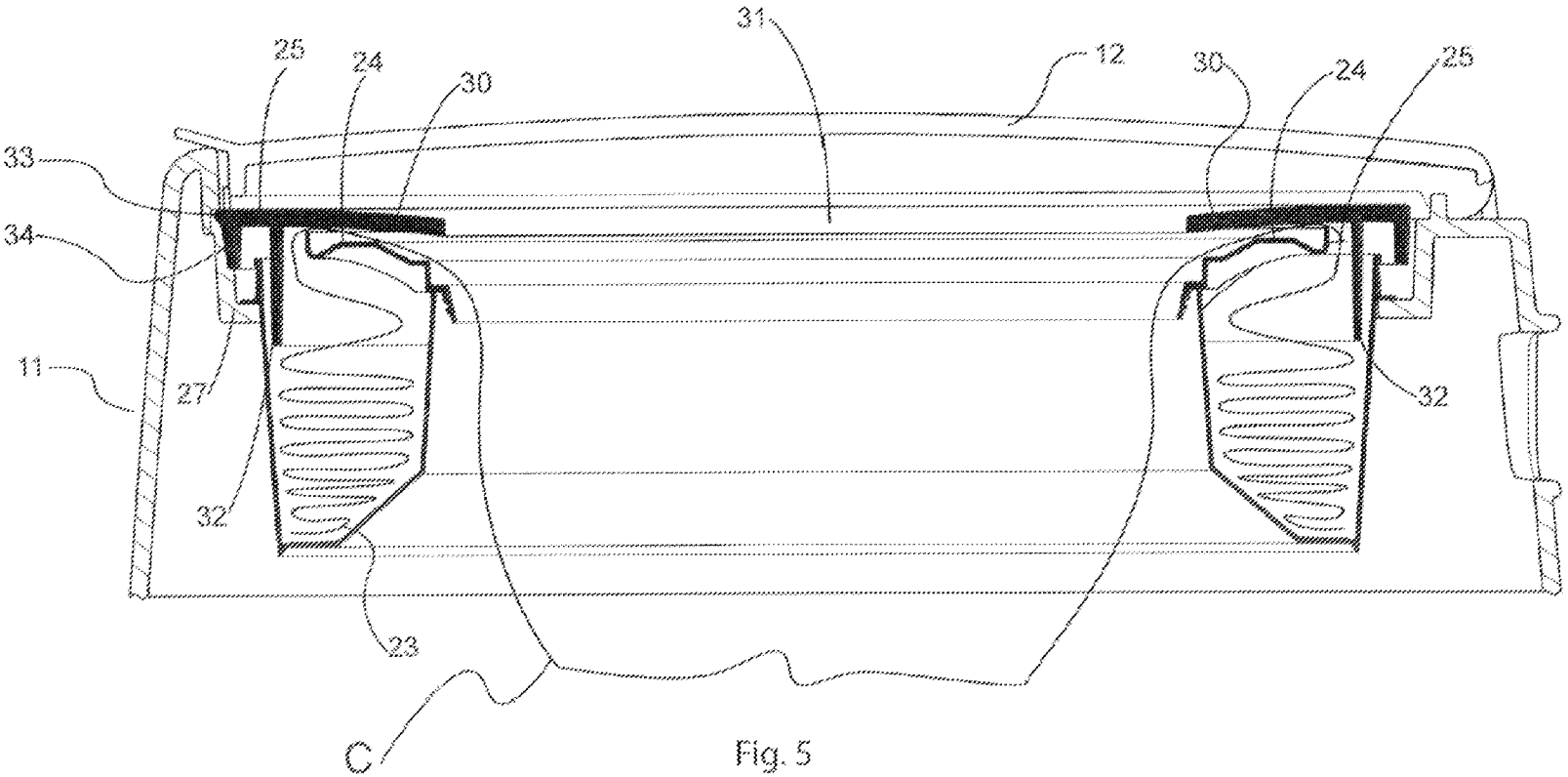
FIG. 5 is a sectional view of the waste-disposal system of FIG. 1, with tubular film dispensed by the tube-dispensing unit during use of the waste-disposal system.

Referring to FIG. 2-3, the tube-dispensing unit 14 has a generally annular hollow body 23 to accommodate tubular film in an accumulated condition (as seen in FIG. 5 with bag C), for subsequent dispensing thereof. The annular hollow body 23 may have a generally U-shaped section, with the tubular film being accumulated in the bottom of the U. However, any other appropriate tube-dispensing unit 14 may be used, such as sleeves supporting bag, rimmed bags, etc, with appropriate hook means to hang the tube-dispensing unit 14 to the bin 11, as detailed hereinafter. Moreover, the outer shape of the hollow body may be any appropriate shape, such as that of a square, an ellipse, a circle, etc. The expression "annular" indicates the presence of a central opening.

A cover 24 may be provided to partially cover the annular hollow body 23, such that an annular spacing 25 is defined concurrently by the body 23 and the cover 24. The annular spacing 25 may be initially covered by a tear strip. The tubular film is dispensed via the annular spacing 25, as shown in greater detail hereinafter. However, in an embodiment, the tube-dispensing unit 14 does not have any cover 24, and the annular spacing 25 is defined as the spacing between the top edges of an outer annular wall 26 and an inner annular wall of the hollow body 23.

The outer annular wall 26 is part of the annular hollow body 23. The outer annular wall 26 defines the outer peripheral portion of the tube-dispensing unit 14. A peripheral flange 27 projects radially from the outer annular wall 26. As shown in FIG. 3, the peripheral flange 27 is seated on the flange 22 of the bin 11. As alternatives to a peripheral flange 27, the tube-dispensing unit 14 may have an upper rim to be seated on the flange 22, or hooks or tabs instead of the outer annular wall 26. As yet another alternative, the annular hollow body 23 may be seated directly on the flange 22. In such cases, the distance between the flange 22 and the open top end 20 of the bin 11 is defined as a function of the seating arrangement between the tube-dispensing unit 14 and the flange 22.

Referring to FIG. 3, the funnel 13 is shown being displaced into a closed position relative to the open top end 20 of the bin 11. The funnel 13 has an annular wall 30, that will define a central opening 31 of the bin 11. In the illustrated embodiment, the annular wall 30 is pivotally connected to the bin 11, and is therefore pivoted as shown by direction B. It is pointed out that the funnel 13 may also be detachable from the bin 11, and simply be disposed in the closed position.

Therefore, the annular wall 30 of the funnel 13 may be shaped so as to taper slightly towards the middle, and may have any appropriate outer shape, usually in accordance with that of the open top end. Because of the slightly tapering top surface of the annular wall 30 of the funnel 13, any waste inadvertently received on the top surface of the funnel 13 may be guided towards the central opening 31 by the effect of gravity on the slightly tapering surface of the funnel 13.

The funnel 13 has a plunger wall 32 extending downwardly from an undersurface of the annular wall 30. As observed in FIG. 1, the plunger wall 32 of the illustrated embodiment does not cover the full periphery of the annular wall 30, as it is disrupted near the pivot of the funnel 13 with the bin 11. The plunger wall 32 could cover the full periphery of the annular wall 30 (i.e., 360° as in FIGS. 3 and 4), or could be made of separate segments of plunger wall 32. The funnel 13 may have one or more downward projection of any suitable shape, as alternatives to the plunger wall 32. For simplicity, reference will be made to the plunger wall 32 hereinafter.

Figure 4:
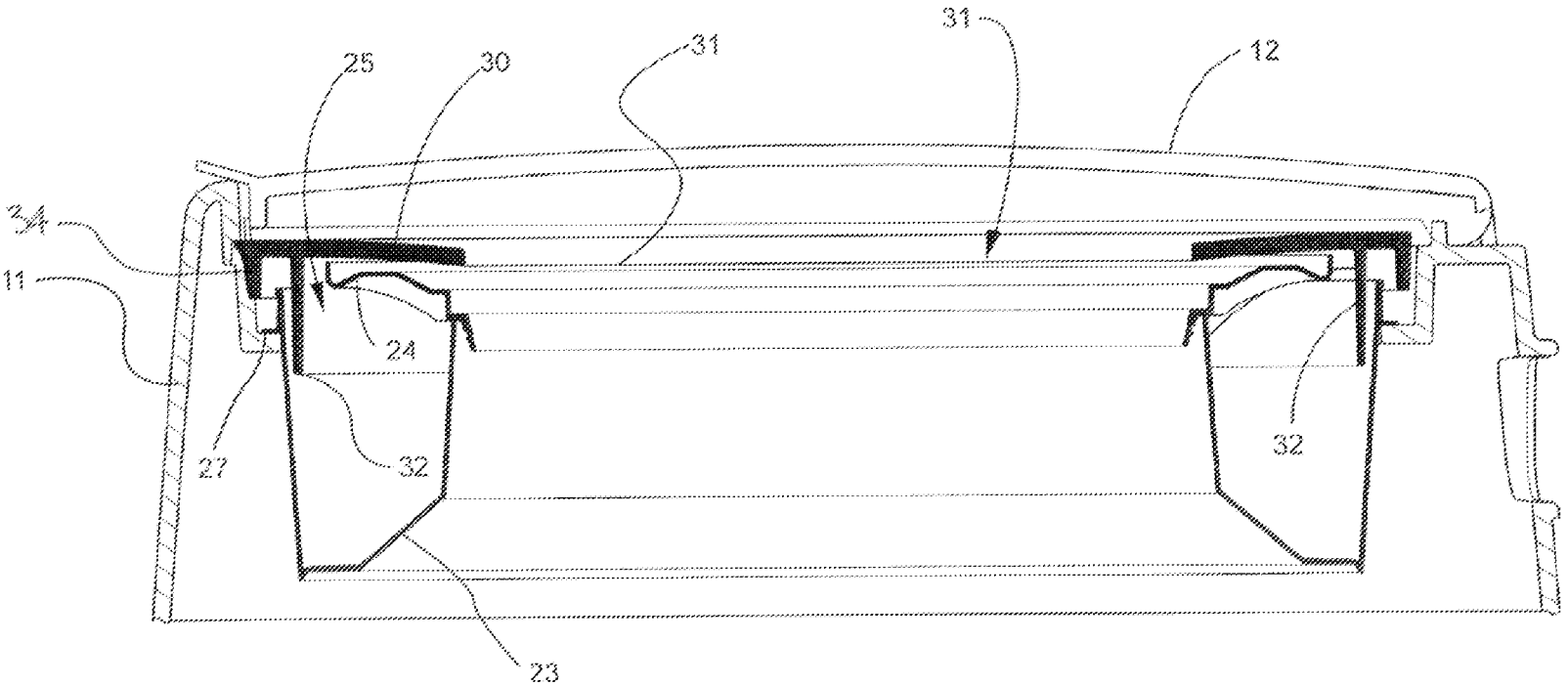
FIG. 4 is a sectional view of the waste-disposal system subsequent to FIG. 3, with the funnel and a lid in a closed position.

As also shown in FIGS. 3 and 4, the funnel 13 may have a tab 33 to snap into engagement with a portion of the bin 11, for releasably securing the funnel 13 in place. The wall 34 may be used to strengthen the wall 30.

Referring to FIG. 4, the plunger wall 32 is shown penetrating into the annular hollow body 23, through the annular spacing 25. The plunger wall 32 is in close proximity to the outer annular wall 26, but is spaced from outer peripheral edge of the cover 24, such that the tubular film may be dispensed between the plunger wall 32 and the outer peripheral edge. It is observed that the tip of the plunger wall 32 (or other downward projection) is lower than an uppermost edge of the tube-dispensing unit 14, and inward of an outermost edge of the tube dispensing unit 14. In the illustrated embodiment, the uppermost edge of the tube-dispensing unit 14 is part of the cover 24, and the outermost edge of the tube dispensing unit 14 is part of the outer annular wall 26. The uppermost edge of the tube-dispensing unit 14 may alternatively be part of the outer annular wall 26, and/or the inner annular wall of the unit 14. The tip of the plunger wall 32 parentheses or other downward projection) therefore penetrates a volume defined by the annular hollow body 23 or by a combination of the tube-dispensing unit 14 and the bin 11.

Once the funnel 13 is in the closed position as in FIGS. 3 and 4, the lid 12 may be pivoted or installed in the closed position, as shown in FIG. 4. During use, the funnel 13 remains in the closed position, while the lid 12 is opened and closed to access an interior of the bin 11. Although not shown, the lid 12 may have a tab (or more) similar to the tab 33 but offset therefrom, to snap into releasable engagement with the bin 12.

According to an embodiment, the plunger wall 32 may be part of the lid 12, in the absence of a funnel 13. In such a case, the lid 12 would not close if the tube-dispensing unit 14 is not oriented correctly.

Because of the plunging feature of the funnel 13 via the plunger wall 32, the lid 12 and the funnel 13 may not close correctly (i.e., to the closed position of FIG. 4) unless the tube-dispensing unit 14 is installed in the correct orientation (FIG. 4). If the tube-dispensing unit 14 were installed upside down (the U being inverted), the plunger wall 32 would abut against the tube-dispensing unit 14, preventing the funnel 13, and the lid 12, from reaching the closed position.

Some parts of the tube-dispensing unit 14, such as the outer annular wall 26, may be made of relatively thin plastic walls. In some cases, thin-wall molding techniques may also be used to mold the outer annular wall 26. Considering that a pressure is exerted on the outer annular wall 26 by the weight of waste in the tubular film, or by pulling manipulations on the tubular film for the dispensing thereof, there may be a risk that the outer annular wall 26 deforms, potentially resulting in the tube-dispensing unit 14 dislodging from engagement with the flange 22. However, the close proximity between the outer annular wall 26 and the plunger wall 32 increases the structural integrity of the assembly, and may keep the peripheral flange 27 caught into engagement with the flange 22. The outer annular wall 26 is sandwiched between the plunger wall 32 and the flange 22.

Referring to FIG. 5, tubular film C is shown dispensed out of the tube-dispensing unit 14. The free end of the tubular film C passes through the annular spacing 25, between a top surface of the cover 24 and an undersurface of the funnel 13, to then pass through the central opening 31. The free end of the tubular film C is knotted or closed inside the inner cavity of the bin 11, to form a bag to accommodate the odorous waste. The tubular film C may be any appropriate type of film. For instance, it is considered to use a polypropylene film with a coating of EVOH, among other possibilities. It is observed that the tubular film C covers the cover 24 and the annular body 23, protecting same from being contamined with the waste. If the cover 24 were incorrectly inserted, the tubular film C would not shield the annular body 23, exposing same to contamination. Hence, the use of the downward projection prevents the tube-dispensing unit 14 from being misoriented, and thus ensures that the tubular film C shields the annular body 23.

The invention claimed is:

1. A waste-disposal system, comprising:

a bag unit having an annular body with an annular cavity defined between an inner annular wall and an outer annular wall of the annular body, the annular body having an uppermost edge, an outermost edge, and an innermost edge, tubular film being disposed in the annular cavity between the outermost and innermost edges;

a bin having an open top end for accessing an inner cavity of the bin, a support in the bin being adapted to support the annular body of the bag unit at the open top end for waste to be received in the tubular film of the bag unit in the inner cavity of the bin; and a covering device removably positioned on the bin at the open top end, the covering device comprising a body for covering at least a portion of the annular body of the bag unit when installed on the top open end, the covering device, when covering the at least a portion of the annular body, having at least one downward projection with at least a tip received in the annular cavity of the annular body, the tip being positioned lower than the uppermost edge of the annular body, inward of the outermost edge, and outward of the innermost edge.

2. The waste-disposal system according to claim 1, wherein the covering device is a funnel comprising an annular wall defining a central opening for dumping waste therethrough into the bin.

3. The waste-disposal system according to claim 2, wherein the funnel is pivotally connected to the bin.

4. The waste-disposal system according to claim 1, wherein the at least one downward projection is a peripheral wall.

5. The waste-disposal system according to claim 4, wherein the peripheral wall has a 360° annular periphery.

6. The waste-disposal system according to claim 1, wherein, when the covering device is covering the at least a portion of the annular body, the outer annular wall of the annular body is sandwiched between the downward projection and the support of the bin.

7. The waste-disposal system according to claim 1, wherein a flange is defined on the outer annular wall, the flange cooperating with the support of the bin when the bag unit is supported by the bin.

8. The waste-disposal system according to claim 1, wherein the bag unit comprises a cover, with an annular opening being defined between an edge of the cover and an edge of the outer annular wall, with a free end of the tubular film exiting the annular body through the annular opening and with the downward projection entering the bag unit through the annular opening and outward of the free end of the tubular film.

9. The waste-disposal system according to claim 1, wherein the covering device is a lid closing the open top end of the bin.

10. The waste-disposal system according to claim 1, further comprising snap-fitting means between the covering device and the bin for releasably locking the covering device to the bin.

11. A method for inserting a bag unit in a bin comprising:

positioning an annular body of the bag unit in an open top end of the bin such that tubular film distinct from and supported by the annular body has a free end projecting out of the annular body through a central opening thereof and into an inner cavity of the bin; and inserting a downward projection of a covering device in an annular cavity inward of an outer annular wall and outward of an inner annular wall of the annular body, the downward projection being lower than an uppermost edge of the annular body of the bag unit, inward of an outermost edge of the annular body of the bag unit, and outward of an innermost edge of annular body of the bag unit by installing the covering device on the open top end of the bin.

12. The method according to claim 11, further comprising removing a previously used bag unit from the bin prior to positioning the bag unit therein.

13. The method according to claim 11, wherein installing the covering device comprises pivoting the covering device into engagement with the bin.

* * * * *